US012606287B2

(12) United States Patent
Saruwatari et al.

(10) Patent No.: US 12,606,287 B2
(45) Date of Patent: Apr. 21, 2026

(54) OUTBOARD MOTOR AND MARINE VESSEL

(71) Applicant: YAMAHA HATSUDOKI KABUSHIKI KAISHA, Iwata (JP)

(72) Inventors: Kimitaka Saruwatari, Shizuoka (JP); Tomohiro Hagi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 638 days.

(21) Appl. No.: 18/094,417

(22) Filed: Jan. 9, 2023

(65) Prior Publication Data

US 2023/0219672 A1 Jul. 13, 2023

(30) Foreign Application Priority Data

Jan. 13, 2022 (JP) ..... 2022-003771

(51) Int. Cl.
*B63H 20/12* (2006.01)
*B63H 20/14* (2006.01)
*B63H 23/34* (2006.01)

(52) U.S. Cl.
CPC ..... *B63H 20/12* (2013.01); *B63H 20/14* (2013.01); *B63H 23/34* (2013.01)

(58) Field of Classification Search
CPC ..... B63H 20/12; B63H 20/14; B63H 23/34
See application file for complete search history.

(56) References Cited

U.S. PATENT DOCUMENTS

| | | | | |
|---|---|---|---|---|
| 5,224,888 | A * | 7/1993 | Fujimoto | B63H 20/08 248/641 |
| 5,244,426 | A * | 9/1993 | Miyashita | B63H 20/12 114/144 R |
| 8,246,399 | B2 * | 8/2012 | Inaba | B63H 20/12 440/58 |
| 10,800,502 | B1 * | 10/2020 | Alby | B63H 20/28 |

FOREIGN PATENT DOCUMENTS

| | | |
|---|---|---|
| JP | 62-72268 U | 5/1987 |
| JP | 3-10995 A | 1/1991 |

* cited by examiner

*Primary Examiner* — Stephen P Avila
(74) *Attorney, Agent, or Firm* — Keating & Bennett, LLP

(57) ABSTRACT

An outboard motor includes a steering mechanism including a pinion located in a central portion of an outboard motor body in a right-left direction and operable to rotate together with the outboard motor body, a rack operable to linearly move to rotate the pinion, and a rack position detector on a first side of the rack opposite to the pinion to detect a position of the rack.

20 Claims, 7 Drawing Sheets

OUTBOARD MOTOR AND MARINE VESSEL

CROSS REFERENCE TO RELATED APPLICATIONS

This application claims the benefit of priority to Japanese Patent Application No. 2022-003771 filed on Jan. 13, 2022. The entire contents of this application are hereby incorporated herein by reference.

BACKGROUND OF THE INVENTION

1. Field of the Invention

The present invention relates to an outboard motor and a marine vessel, and more particularly, it relates to an outboard motor and a marine vessel each including a steering mechanism including a rotary member that rotates together with an outboard motor body and a linearly moving member that linearly moves to rotate the rotary member, and operable to rotate the outboard motor body about a steering shaft.

2. Description of the Related Art

An outboard motor including a steering mechanism including a rotary member that rotates together with an outboard motor body and a linearly moving member that linearly moves to rotate the rotary member, and operable to rotate the outboard motor body about a steering shaft is known in general. Such an outboard motor is disclosed in U.S. Pat. No. 10,800,502, for example.

U.S. Pat. No. 10,800,502 discloses an outboard motor including a steering mechanism to rotate an outboard motor body about a steering shaft. In the outboard motor disclosed in U.S. Pat. No. 10,800,502, the steering mechanism includes a rotary member (a pinion, for example) that is located in a central portion of the outboard motor body in a right-left direction and rotates together with the outboard motor body, and a linearly moving member (a rack, for example) that linearly moves along the right-left direction of the outboard motor body to rotate the rotary member. In the outboard motor disclosed in U.S. Pat. No. 10,800,502, a drive shaft penetrates through a through-hole provided in the rotary member and transmits a driving force from an engine to a propeller. That is, the rotary member and the drive shaft are coaxial with each other.

Although not disclosed in U.S. Pat. No. 10,800,502, in a conventional outboard motor as disclosed in U.S. Pat. No. 10,800,502, it is necessary to detect an angle at which an outboard motor body is rotated about a steering shaft in order to perform a control to rotate the outboard motor body about the steering shaft. Therefore, it is conceivable to detect the rotational position of a rotary member (a pinion, for example) that rotates together with the outboard motor body in order to detect the rotation angle of the outboard motor body about the steering shaft. However, in the outboard motor disclosed in U.S. Pat. No. 10,800,502, the drive shaft penetrates through the through-hole provided in the rotary member and transmits a driving force from the engine to the propeller, and thus it is difficult to provide coaxially with the rotary member (i.e., coaxially with the steering shaft) a detector to detect the rotational position of the rotary member. Therefore, it is desired to detect an angle at which the outboard motor body is rotated about the steering shaft without providing coaxially with the steering shaft a detector to detect the angle at which the outboard motor body is rotated about the steering shaft.

SUMMARY OF THE INVENTION

Preferred embodiments of the present invention provide outboard motors and marine vessels that each detect angles at which outboard motor bodies are rotated about steering shafts at positions spaced apart from the steering shafts without providing detectors coaxially with the steering shafts to detect the angles at which the outboard motor bodies are rotated about the steering shafts.

An outboard motor according to a preferred embodiment of the present invention includes an outboard motor body and a steering mechanism to rotate the outboard motor body about a steering shaft. The steering mechanism includes a pinion located in a central portion of the outboard motor body in a right-left direction and operable to rotate together with the outboard motor body, a rack operable to linearly move to rotate the pinion, and a rack position detector on a first side of the rack opposite to the pinion to detect a position of the rack.

In an outboard motor according to a preferred embodiment of the present invention, the steering mechanism includes the rack operable to linearly move to rotate the pinion, and the rack position detector to detect the position of the rack. Accordingly, the position of the rack that linearly moves is detected by the rack position detector such that the rotational position of the pinion that rotates together with the outboard motor body is detected. That is, an angle at which the outboard motor body is rotated about the steering shaft is detected. Furthermore, the rack position detector is on the first side of the rack opposite to the pinion. That is, the rack position detector is not coaxial with the pinion and is spaced apart from the pinion. Consequently, the angle at which the outboard motor body is rotated about the steering shaft is detected at a position spaced apart from the steering shaft without providing coaxially with the steering shaft a detector to detect the angle at which the outboard motor body is rotated about the steering shaft. Furthermore, the rack position detector is on the first side of the rack opposite to the pinion such that when a driving mechanism is provided separately from the rack on a second side (pinion side) of the rack to drive the pinion, the rack position detector does not interfere with the driving mechanism.

In an outboard motor according to a preferred embodiment of the present invention, the rack position detector preferably includes a detected rotary member operable to rotate as the rack linearly moves. Accordingly, the position of the rack that linearly moves is easily detected by detecting rotation of the detected rotary member.

In such a case, the rack preferably includes a gear portion provided on the first side of the rack, and the rack position detector preferably includes a rack position detection gear corresponding to the detected rotary member operable to engage with the gear portion. Accordingly, the position of the rack that linearly moves is more easily detected by detecting the rotational position of the rack position detection gear that engages with the gear portion of the rack.

In an outboard motor including the rack position detector including the rack position detection gear, the rack position detection gear preferably has an outer diameter smaller than an outer diameter of the pinion. Accordingly, when the outer diameter of the pinion is constant, the size of the rack position detection gear is relatively small as compared with a case in which the outer diameter of the rack position detection gear is larger than the outer diameter of the pinion, and thus the rack position detector is provided in the steering mechanism while an increase in the size of the steering mechanism is reduced or prevented.

In such a case, the outer diameter of the rack position detection gear is preferably less than or equal to half of the outer diameter of the pinion. Accordingly, when the outer diameter of the pinion is constant, the size of the rack position detection gear is sufficiently small, and thus the rack position detector is provided in the steering mechanism while an increase in the size of the steering mechanism is reliably reduced or prevented.

In an outboard motor including the rack position detection gear having the outer diameter smaller than the outer diameter of the pinion, the gear portion and the rack position detection gear preferably have tooth pitches smaller than a tooth pitch of the pinion. Accordingly, when the number of gear teeth is fixed, the outer diameter of the gear becomes smaller as the tooth pitch of the gear becomes smaller. Thus, the outer diameter of the rack position detection gear is easily smaller than the outer diameter of the pinion due to the tooth pitches of the gear portion and the rack position detection gear being smaller than the tooth pitch of the pinion.

In an outboard motor according to a preferred embodiment of the present invention, the pinion preferably includes a through-hole in a central portion of the pinion as viewed in an upward-downward direction of the outboard motor body, and the outboard motor body preferably includes an engine on an upper side of the outboard motor body, a propeller on a lower side of the outboard motor body, and a drive shaft extending in the upward-downward direction of the outboard motor body, operable to transmit a driving force from the engine to the propeller, and penetrating through the through-hole of the pinion. Accordingly, the drive shaft penetrating through the through-hole of the pinion does not change its position in the outboard motor even when the outboard motor body is rotated about the steering shaft, and thus the outboard motor body is rotated about the steering shaft without preventing the drive shaft from transmitting a driving force from the engine to the propeller.

In an outboard motor according to a preferred embodiment of the present invention, the steering mechanism preferably further includes a first drive source to drive the pinion by linearly moving the rack, a driving force transmission to transmit a driving force to the pinion, and a second drive source to drive the pinion via the driving force transmission. The steering mechanism is preferably switchable between a state in which the pinion is rotated by the first drive source such that the outboard motor body is steerable within a first steering angle range and a state in which the pinion is rotated by the second drive source such that the outboard motor body is steerable within a second steering angle range different from the first steering angle range. The steering mechanism is preferably operable to engage the rack with the pinion when the pinion is rotated by the first drive source, and is preferably operable to not engage the rack with the pinion when the pinion is not rotated by the first drive source. The steering mechanism preferably further includes a pinion position detector to detect a rotational position of the pinion. Accordingly, the pinion position detector detects the rotational position of the pinion, and thus in combination with detection of the position of the rack by the rack position detector, the rack and the pinion are engaged with each other at a preset, predetermined position when a state in which the rack does not engage with the pinion is switched to a state in which the rack engages with the pinion.

In such a case, the pinion position detector preferably includes a pinion position detection gear to engage with the pinion. Accordingly, rotation of the pinion position detection gear that engages with the pinion is detected such that the rotational position of the pinion is easily detected.

In an outboard motor including the pinion position detector including the pinion position detection gear, the pinion position detection gear preferably has a gear ratio of about 1:1 to the pinion. Accordingly, the rotation speed of the pinion position detection gear is equal or substantially equal to the rotation speed of the pinion, and thus the apparatus structure is simplified. For example, when the gear ratio of the pinion position detection gear to the pinion is not about 1:1, one of the pinion position detection gear and the pinion may rotate two or more times while the other of the pinion position detection gear and the pinion rotates once. In such a case, it is necessary to provide a sensor to detect the rotation speed of one of the pinion position detection gear and the pinion.

In an outboard motor including the steering mechanism switchable between a state in which the pinion is rotated by the first drive source such that the outboard motor body is steerable within the first steering angle range and a state in which the pinion is rotated by the second drive source such that the outboard motor body is steerable within the second steering angle range, the steering mechanism is preferably switchable between a state in which the pinion is rotated by a hydraulic actuator corresponding to the first drive source such that the outboard motor body is steerable within the first steering angle range and a state in which the pinion is rotated by an electric motor corresponding to the second drive source such that the outboard motor body is steerable within the second steering angle range having an upper limit larger than an upper limit of the first steering angle range. When a marine vessel navigates at a relatively high speed, a relatively large load is applied to a drive source, and thus an angle at which the outboard motor body is steered is limited within a relatively small angular range. On the other hand, when the marine vessel navigates at a relatively low speed, only a relatively small load is applied to the drive source, and thus the outboard motor body may be steered at a relatively large angle. Accordingly, when the marine vessel navigates at a relatively high speed, the pinion is rotated by the hydraulic actuator to steer the outboard motor body within the first steering angle range, as described above, such that a relatively large load to be applied to the drive source is easily received by a hydraulic pressure. When the marine vessel navigates at a relatively low speed, the pinion is rotated by the electric motor to steer the outboard motor body within the second steering angle range having an upper limit larger than the upper limit of the first steering angle range, as described above, such that the outboard motor body is easily steered at a relatively large angle. That is, the two drive sources are appropriately used to steer the outboard motor body.

In an outboard motor according to a preferred embodiment of the present invention, the outboard motor body preferably includes an upper portion to be attached to a hull via a bracket, and a lower portion located below the upper portion and on which a propeller is provided, and the steering mechanism is preferably operable to rotate the lower portion about the steering shaft with respect to the upper portion. Accordingly, in a structure in which the lower portion is rotated about the steering shaft with respect to the upper portion, the angle at which the outboard motor body is rotated about the steering shaft is detected at a position spaced apart from the steering shaft without providing coaxially with the steering shaft a detector to detect the angle at which the outboard motor body is rotated about the steering shaft.

An outboard motor according to a preferred embodiment of the present invention includes an outboard motor body and a steering mechanism to rotate the outboard motor body about a steering shaft. The steering mechanism includes a rotary member located in a central portion of the outboard motor body in a right-left direction and operable to rotate together with the outboard motor body, a linearly moving member operable to linearly move to rotate the rotary member, and a linearly moving member position detector provided on a first side of the linearly moving member opposite to the rotary member to detect a position of the linearly moving member.

In an outboard motor according to a preferred embodiment of the present invention, the steering mechanism includes the linearly moving member operable to linearly move to rotate the rotary member, and the linearly moving member position detector to detect the position of the linearly moving member. Accordingly, the position of the linearly moving member that linearly moves is detected by the linearly moving member position detector such that the rotational position of the rotary member that rotates together with the outboard motor body is detected. That is, an angle at which the outboard motor body is rotated about the steering shaft is detected, similarly to the outboard motors according to preferred embodiments of the present invention described above. Furthermore, the linearly moving member position detector is provided on the first side the linearly moving member opposite to the rotary member. That is, the linearly moving member position detector is not coaxial with the rotary member and is spaced apart from the rotary member. Consequently, similarly to the outboard motors according to preferred embodiments of the present invention described above, the angle at which the outboard motor body is rotated about the steering shaft is detected at a position spaced apart from the steering shaft without providing coaxially with the steering shaft a detector to detect the angle at which the outboard motor body is rotated about the steering shaft. Furthermore, similarly to the outboard motors according to preferred embodiments of the present invention described above, when a driving mechanism is provided separately from the linearly moving member on the first side of the linearly moving member to drive the rotary member, the linearly moving member position detector does not interfere with the driving mechanism.

A marine vessel according to a preferred embodiment of the present invention includes a hull and an outboard motor attached to a stern of the hull. The outboard motor includes an outboard motor body and a steering mechanism to rotate the outboard motor body about a steering shaft. The steering mechanism includes a pinion located in a central portion of the outboard motor body in a right-left direction and operable to rotate together with the outboard motor body, a rack operable to linearly move to rotate the pinion, and a rack position detector provided on a first side of the rack opposite to the pinion to detect a position of the rack.

In a marine vessel according to a preferred embodiment of the present invention, the steering mechanism includes the rack operable to linearly move to rotate the pinion, and the rack position detector to detect the position of the rack. Furthermore, the rack position detector is provided on the first side of the rack opposite to the pinion. Accordingly, similarly to the outboard motors according to preferred embodiments of the present invention described above, an angle at which the outboard motor body is rotated about the steering shaft is detected at a position spaced apart from the steering shaft without providing coaxially with the steering shaft a detector to detect the angle at which the outboard motor body is rotated about the steering shaft. Furthermore, similarly to the outboard motors according to preferred embodiments of the present invention described above, when a driving mechanism is provided separately from the rack on a second side (pinion side) of the rack to drive the pinion, the rack position detector does not interfere with the driving mechanism.

In a marine vessel according to a preferred embodiment of the present invention, the rack position detector preferably includes a detected rotary member operable to rotate as the rack linearly moves. Accordingly, similarly to the outboard motors according to preferred embodiments of the present invention described above, the position of the rack that linearly moves is easily detected.

In such a case, the rack preferably includes a gear portion provided on the first side of the rack, and the rack position detector preferably includes a rack position detection gear corresponding to the detected rotary member operable to engage with the gear portion. Accordingly, similarly to the outboard motors according to preferred embodiments of the present invention described above, the position of the rack that linearly moves is more easily detected.

In a marine vessel including the rack position detector including the rack position detection gear, the rack position detection gear preferably has an outer diameter smaller than an outer diameter of the pinion. Accordingly, similarly to the outboard motors according to preferred embodiments of the present invention described above, the rack position detector is provided in the steering mechanism while an increase in the size of the steering mechanism is reduced or prevented.

In such a case, the outer diameter of the rack position detection gear is preferably less than or equal to half of the outer diameter of the pinion. Accordingly, similarly to the outboard motors according to preferred embodiments of the present invention described above, the rack position detector is provided in the steering mechanism while an increase in the size of the steering mechanism is reliably reduced or prevented.

In a marine vessel including the rack position detection gear having the outer diameter smaller than the outer diameter of the pinion, the gear portion and the rack position detection gear preferably have tooth pitches smaller than a tooth pitch of the pinion. Accordingly, similarly to the outboard motors according to preferred embodiments of the present invention described above, the outer diameter of the rack position detection gear is easily made smaller than the outer diameter of the pinion.

In a marine vessel according to a preferred embodiment of the present invention, the pinion preferably includes a through-hole in a central portion of the pinion as viewed in an upward-downward direction of the outboard motor body, and the outboard motor body preferably includes an engine on an upper side of the outboard motor body, a propeller on a lower side of the outboard motor body, and a drive shaft extending in the upward-downward direction of the outboard motor body, operable to transmit a driving force from the engine to the propeller, and penetrating through the through-hole of the pinion. Accordingly, similarly to the outboard motors according to preferred embodiments of the present invention described above, the outboard motor body is rotated about the steering shaft without preventing the drive shaft from transmitting a driving force from the engine to the propeller.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structures of outboard motors 100 and a marine vessel 120 according to preferred embodiments of the present invention are now described with reference to FIGS. 1 to 6. In the figures, arrow FWD represents the front of the marine vessel 120, arrow BWD represents the rear of the marine vessel 120, arrow L represents the left (port side) of the marine vessel 120, and arrow R represents the right (starboard side) of the marine vessel 120.

Figure 1:
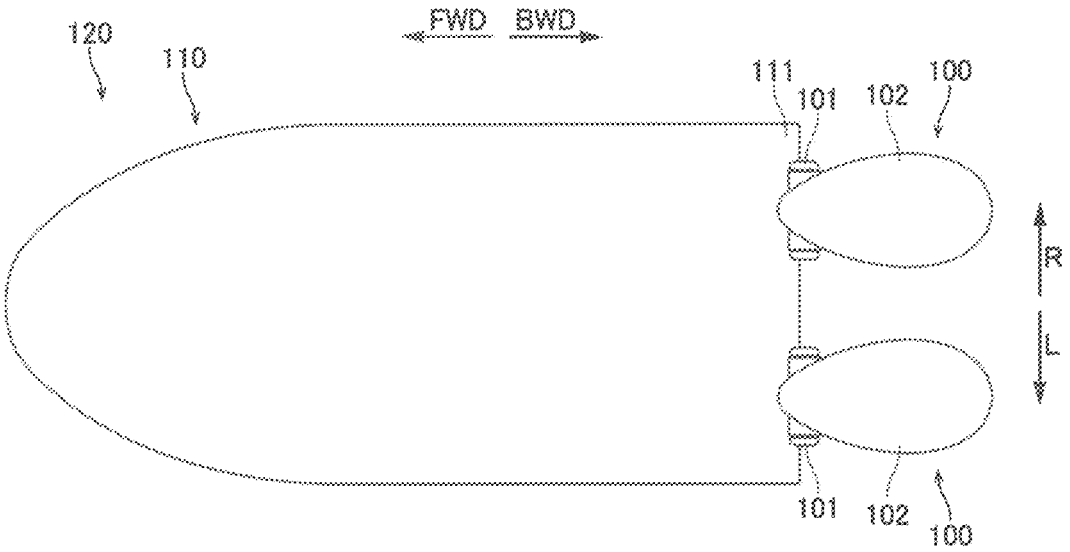
FIG. 1 is a plan view showing a marine vessel according to a preferred embodiment of the present invention.

As shown in FIG. 1, the marine vessel 120 includes a hull 110 and the outboard motors 100. The outboard motors 100 are marine propulsion devices that propel the hull 110. The outboard motors 100 are attached to a stern 111 of the hull 110. A plurality of (two in preferred embodiments of the present invention) outboard motors 100 are attached side by side in the right-left direction of the hull 110. The marine vessel 120 may be a relatively small marine vessel used for sightseeing or fishing, for example.

Figure 2:
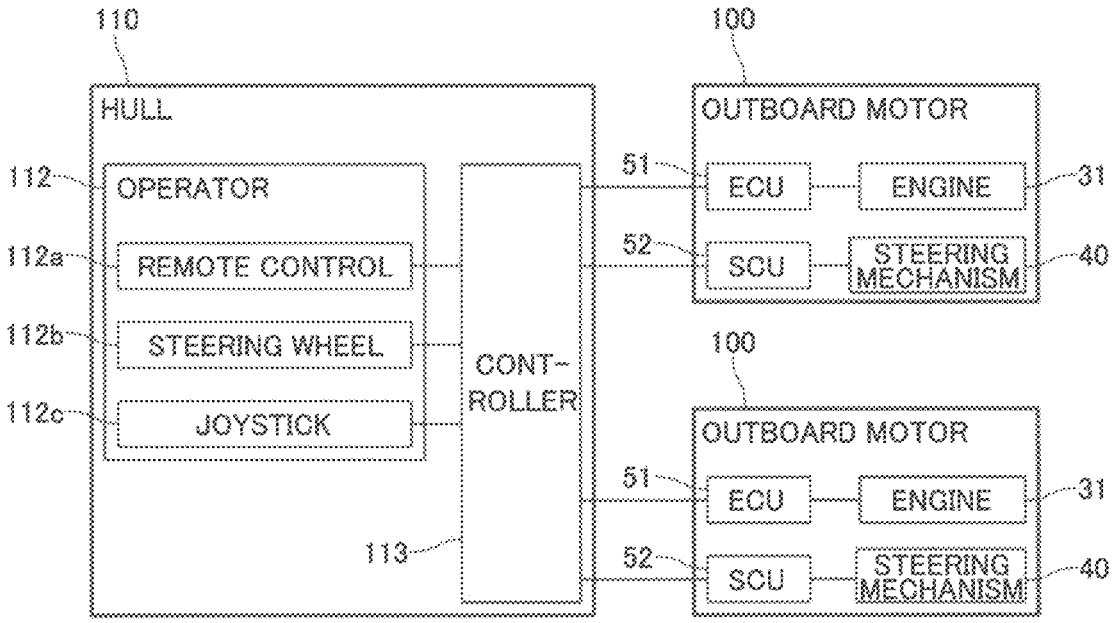
FIG. 2 is a block diagram showing the structure of a control system in a marine vessel according to a preferred embodiment of the present invention.

As shown in FIG. 2, the hull 110 includes an operator 112 to receive an operation to operate (maneuver) the marine vessel 120. The operator 112 includes a remote control 112*a*, a steering wheel 112*b*, and a joystick 112*c*.

The remote control 112*a* includes a tiltable lever. The lever of the remote control 112*a* is tilted such that the thrusts (the rotation speeds of propellers 35 (see FIG. 3)) of the outboard motors 100 are changed and/or the shift states (the forward movement states, the reverse movement states, or the neutral states) of the outboard motors 100 are switched, for example.

The steering wheel 112*b* is rotatable. The steering wheel 112*b* is rotated to steer the outboard motors 100 (change the orientations of the propellers 35 (see FIG. 3) with respect to the hull 110).

The marine vessel 120 (see FIG. 1) is translated and turned, for example, by combinations of operations on the remote control 112*a* and operations on the steering wheel 112*b*.

The joystick 112*c* includes a tiltable and rotatable lever. The lever of the joystick 112*c* is tilted, rotated, or tilted and rotated such that the thrusts of the outboard motors 100 are changed and/or the shift states of the outboard motors 100 are switched, the outboard motors 100 are steered, or the thrusts of the outboard motors 100 are changed and/or the shift states of the outboard motors 100 are switched and the outboard motors 100 are steered, for example.

The lever of the joystick 112*c* is tilted to translate the marine vessel 120 (see FIG. 1). The lever of the joystick 112*c* is tilted and rotated to turn the marine vessel 120. The lever of the joystick 112*c* is rotated to rotate the marine vessel 120.

The joystick 112*c* includes a joystick mode switch. In the marine vessel 120, the joystick mode switch is pressed to switch an operation mode between a joystick mode and a non-joystick mode. In the joystick mode, the marine vessel 120 does not receive operations on the remote control 112*a* and the steering wheel 112*b*, but receives an operation on the joystick 112*c*. In the non-joystick mode, the marine vessel 120 does not receive an operation on the joystick 112*c*, but receives operations on the remote control 112*a* and the steering wheel 112*b*.

The hull 110 includes a controller 113 to control the outboard motors 100 (engine control units (ECUs) 51, steering control units (SCUs) 52, etc. of the outboard motors 100) based on an operation on the operator 112. The controller 113 includes a central processing unit (CPU), a read-only memory (ROM), a random access memory (RAM), etc., for example. The SCU 52 is an example of a "steering controller".

Figure 3:
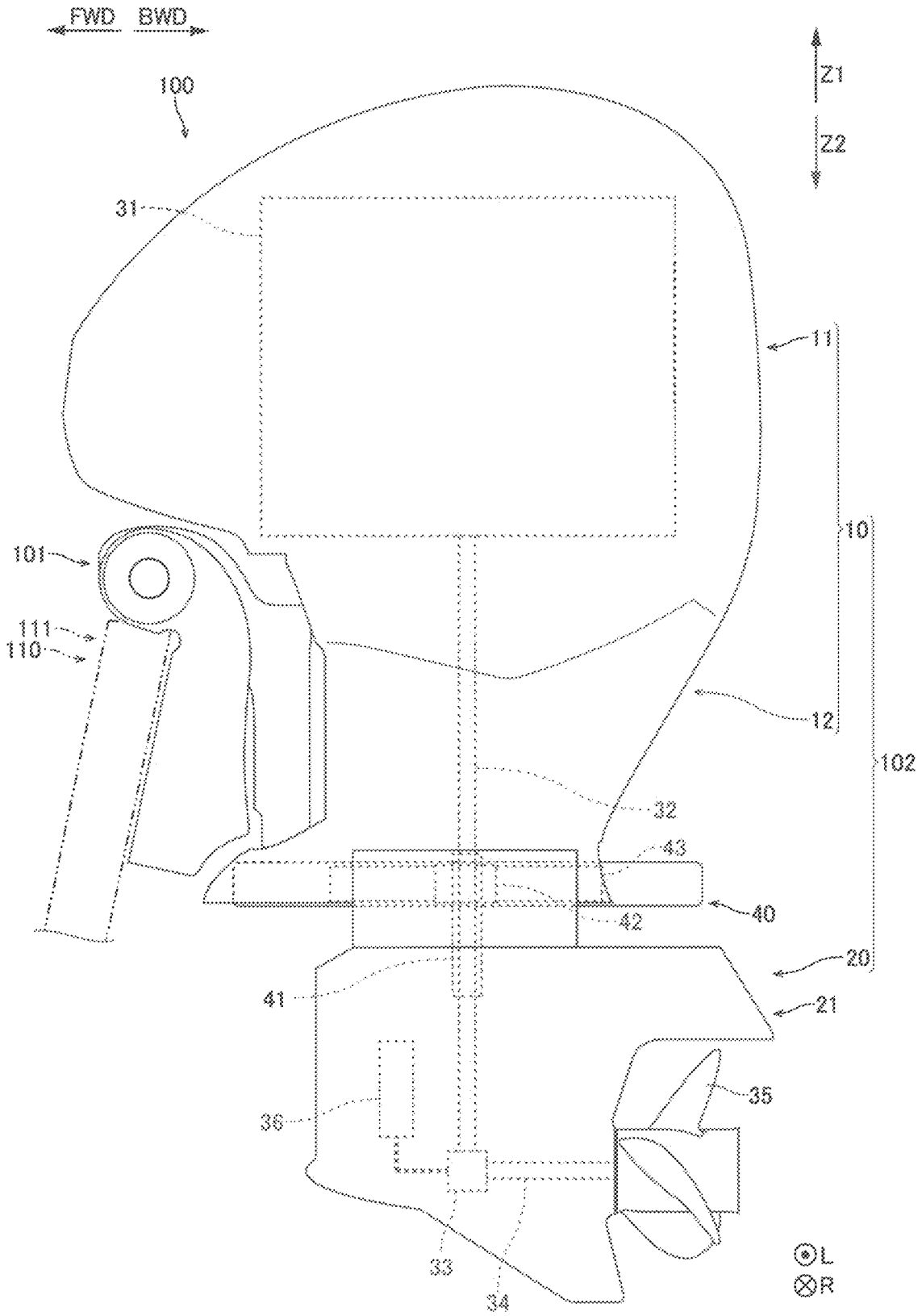
FIG. 3 is a side view showing an outboard motor according to a preferred embodiment of the present invention.

As shown in FIG. 3, each of the outboard motors 100 includes an outboard motor body 102. The outboard motor body 102 includes an upper portion 10 attached to the stern 111 of the hull 110 via a bracket 101, and a lower portion 20 located below the upper portion 10 and on which the propeller 35 is provided. That is, the propeller 35 is located on the lower side of the outboard motor body 102. The upper portion 10 includes a cowling 11 to house an engine 31, and an upper case 12 located below the cowling 11 and attached to the stern 111 of the hull 110. That is, the engine 31 is located on the upper side of the outboard motor body 102. The lower portion 20 includes a lower case 21.

Each of the outboard motors 100 is an engine outboard motor including the engine 31 to drive the propeller 35. Specifically, the outboard motor body 102 includes the engine 31, a drive shaft 32, a gearing 33, a propeller shaft 34, and the propeller 35. The engine 31 is, for example, an internal combustion engine that generates a driving force. The drive shaft 32 extends in an upward-downward direction across the cowling 11 and the lower case 21. The drive shaft 32 is connected to a crankshaft (not shown) of the engine 31. The gearing 33 is located in the lower case 21. The gearing 33 is connected to a lower end of the drive shaft 32. The propeller shaft 34 is connected to the gearing 33. The propeller shaft 34 extends in a forward-rearward direction behind the gearing 33. The propeller 35 is connected to a rear end of the propeller shaft 34. The propeller 35 is located outside the lower case 21 to be exposed to the outside of the outboard motor body 102. A driving force is transmitted from the engine 31 to the propeller 35 via the drive shaft 32, the gearing 33, and the propeller shaft 34. The propeller 35 generates a thrust by rotating in the water due to the driving force transmitted from the engine 31.

The outboard motor body 102 includes a shift actuator 36 to switch the shift state (the forward movement state, the reverse movement state, or the neutral state) of the outboard motor 100. The shift actuator 36 switches the shift state of the outboard motor 100 between the forward movement state, the backward movement state, and the neutral state by switching the meshing of the gearing 33. In the forward movement state of the outboard motor 100, a driving force is transmitted from the engine 31 to the propeller 35 to generate a forward propulsive force from the propeller 35. In the reverse movement state of the outboard motor 100, a driving force is transmitted from the engine 31 to the propeller 35 to generate a reverse propulsive force from the propeller 35. In the neutral state of the outboard motor 100, a driving force is not transmitted from the engine 31 to the propeller 35.

The outboard motor 100 includes a steering mechanism 40 to rotate a portion of the outboard motor body 102 about a steering shaft 41. The steering mechanism 40 rotates the lower portion 20 about the steering shaft 41 with respect to the upper portion 10. That is, in the outboard motor 100, only a portion (the lower portion 20) of the outboard motor body 102 rotates with respect to the hull 110. The steering mechanism 40 is described below in detail.

As shown in FIG. 2, the outboard motor 100 includes the ECU 51 to control the engine 31 and the SCU 52 to control the steering mechanism 40. The ECU 51 controls driving of the engine 31 and driving of the shift actuator 36 based on a control by the controller 113 provided in the hull 110. The SCU 52 controls driving of the steering mechanism 40 based on a control by the controller 113. The ECU 51 and the SCU 52 include a CPU, a ROM, a RAM, etc., for example.

Figure 4:
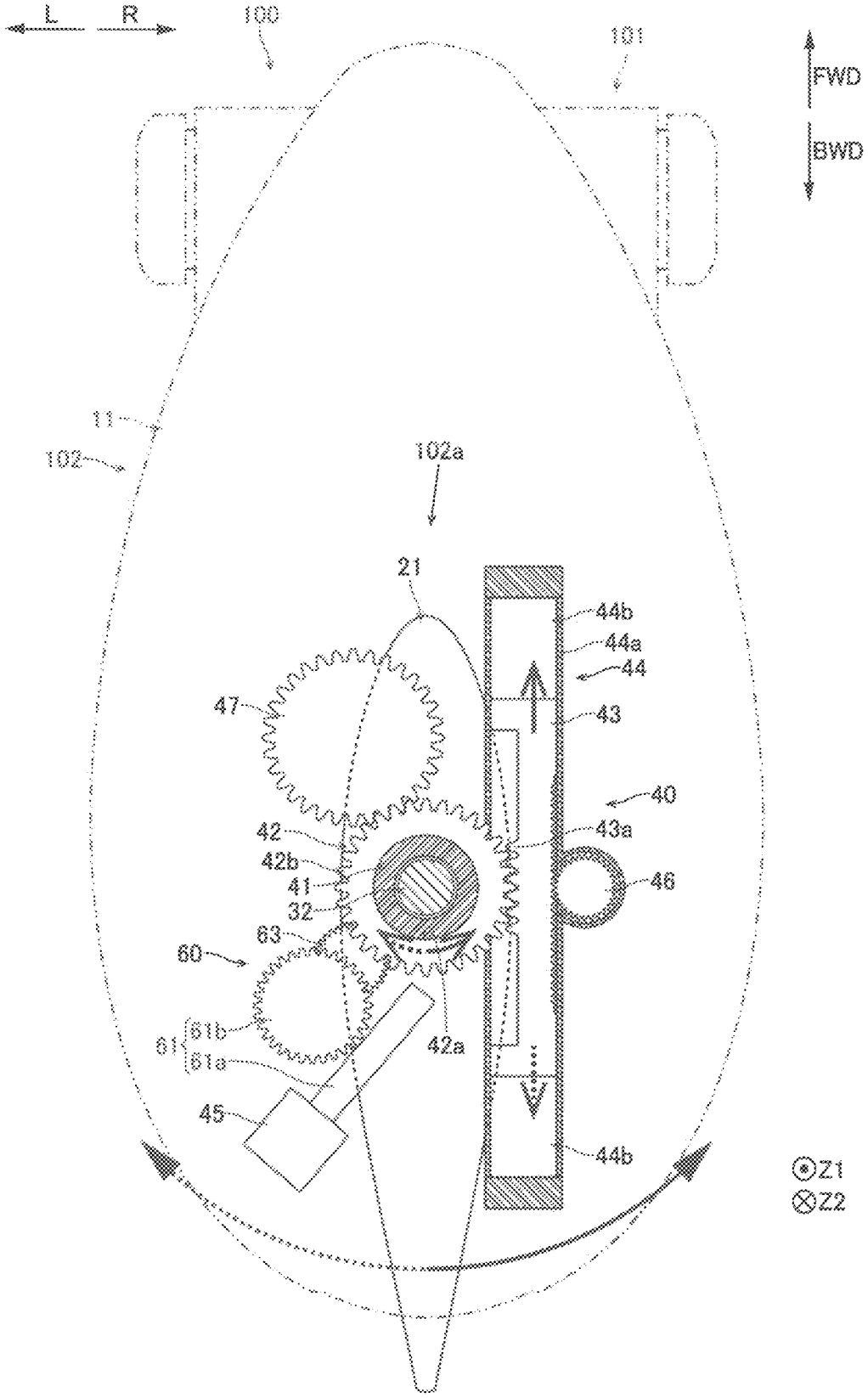
FIG. 4 is a plan view showing a steering mechanism of an outboard motor according to a preferred embodiment of the present invention.

As shown in FIG. 4, the steering mechanism 40 includes a pinion 42 that rotates together with the portion (the lower portion 20) of the outboard motor body 102. The pinion 42 is provided in a central portion 102*a* of the outboard motor body 102 in the right-left direction. A through-hole 42*a* is provided in a central portion of the pinion 42 as viewed in the upward-downward direction of the outboard motor body 102. The steering shaft 41 is provided in the through-hole 42*a*. The pinion 42 is fixed to the steering shaft 41 such that the steering shaft 41 rotates as the pinion 42 rotates.

As shown in FIG. 3, the steering shaft 41 is fixed to an upper portion of the lower case 21 such that the lower case 21 rotates as the steering shaft 41 rotates. The steering shaft 41 extends in the upward-downward direction across a lower portion of the upper case 12 and the upper portion of the lower case 21. As shown in FIG. 4, the steering shaft 41 is hollow. The drive shaft 32 penetrates through a central portion of the steering shaft 41 such that the drive shaft 32 does not contact the steering shaft 41. That is, the drive shaft 32 penetrates through the through-hole 42*a* of the pinion 42.

The steering mechanism 40 includes a rack 43 that linearly moves to rotate the pinion 42, and a hydraulic actuator 44 that linearly moves the rack 43 to drive the pinion 42. That is, the steering mechanism 40 converts linear motion into rotary motion with the rack 43 and the pinion 42. The hydraulic actuator 44 is an example of a "first drive source".

One rack 43 is provided for the pinion 42. The rack 43 is located on the starboard side of the pinion 42. The rack 43 extends along the forward-rearward direction of the outboard motor body 102. The rack 43 includes teeth 43*a* that engage with teeth 42*b* of the pinion 42. The rack 43 is linearly movable along the forward-rearward direction of the outboard motor body 102. When the rack 43 linearly moves along the forward-rearward direction of the outboard motor body 102 while the teeth 43*a* of the rack 43 engage with the teeth 42*b* of the pinion 42, the pinion 42 is rotated.

The hydraulic actuator 44 includes a hydraulic cylinder 44*a* to house the rack 43. The hydraulic cylinder 44*a* extends along the forward-rearward direction. Two oil chambers 44*b* are provided inside the hydraulic cylinder 44*a*. The two oil chambers 44*b* are provided on a first end and a second end of the rack 43 in a direction (the forward-rearward direction of the outboard motor body 102) in which the rack 43 extends. A hydraulic pump (not shown) is driven by a pump drive motor (not shown) to supply hydraulic oil to one of the two oil chambers 44*b* and to discharge hydraulic oil from the other of the two oil chambers 44*b*. The amount of hydraulic oil in the two oil chambers 44*b* is adjusted such that the rack 43 linearly moves inside the hydraulic cylinder 44*a*.

The steering mechanism 40 includes a driving force transmission mechanism 60 to transmit a driving force to the pinion 42 and an electric motor 45 to drive the pinion 42 via the driving force transmission mechanism 60. The electric motor 45 is an example of a "second drive source".

Figure 5:
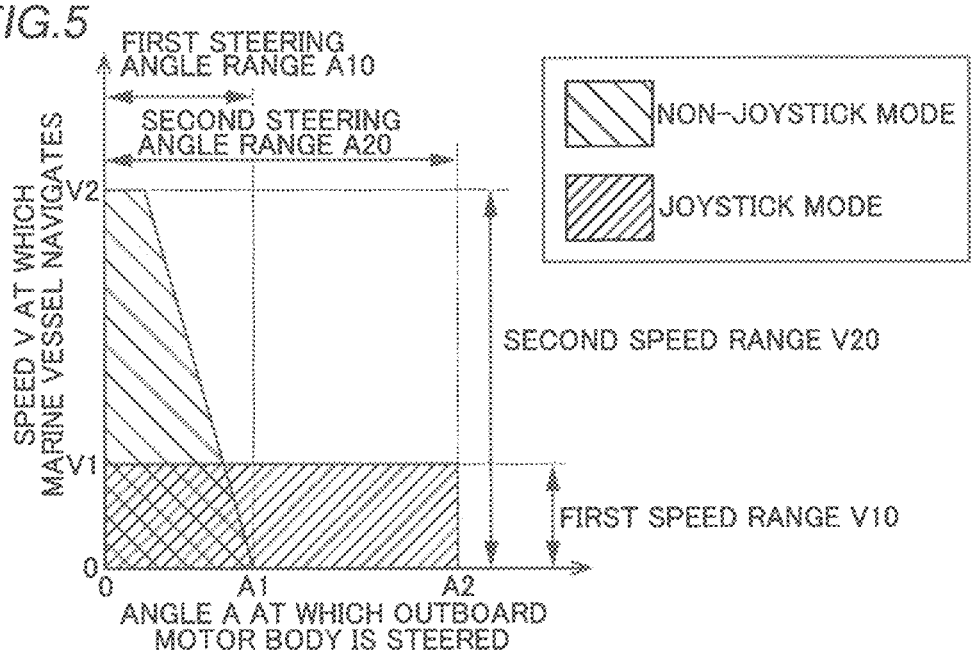
FIG. 5 is a diagram showing ranges of speeds at which a marine vessel navigates and ranges of angles at which an outboard motor body is steered when the operation mode of an outboard motor according to a preferred embodiment of the present invention is in a joystick mode and in a non-joystick mode.

As shown in FIG. 5, the driving force transmission mechanism 60 includes a worm gear 61, a clutch 63, etc. The worm gear 61 includes a worm 61*a* that is rotated by the driving force of the electric motor 45, and a worm wheel 61*b* that engages with teeth of the worm 61*a*. In the worm gear 61, the angle of the teeth of the worm 61*a* is adjusted such that a driving force is not transmitted from the worm wheel 61*b* side to the worm 61*a* side. The clutch 63 is switchable between a state in which a driving force is transmitted from the electric motor 45 to the pinion 42 when the pinion 42 is rotated by the electric motor 45, and a state in which a driving force is not transmitted from the electric motor 45 to the pinion 42 when the pinion 42 is not rotated by the electric motor 45.

As shown in FIG. 5, when the marine vessel 120 navigates at a relatively high speed V, a relatively large load is applied to a drive source, but an angle A at which the outboard motor body 102 is steered (rotated) is limited within a relatively small angular range. On the other hand, when the marine vessel 120 navigates at a relatively low speed V, only a relatively small load is applied to the drive source, but the outboard motor body 102 may be steered at a relatively large angle A.

Therefore, the steering mechanism 40 (see FIG. 5) is switchable between a state in which the pinion 42 (see FIG. 4) is rotated by the hydraulic actuator 44 (see FIG. 4) such that the outboard motor body 102 (see FIG. 4) is steerable within a first steering angle range A10 and a state in which the pinion 42 is rotated by the electric motor 45 (see FIG. 4) such that the outboard motor body 102 is steerable within a second steering angle range A20 including an angular range having an upper limit larger than the upper limit of the first steering angle range A10. Furthermore, the steering mechanism 40 is switchable between a state in which the marine vessel 120 is navigable within a first speed range V10 while the pinion 42 is rotated by the electric motor 45 to steer the outboard motor body 102, and a state in which the marine vessel 120 is navigable within a second speed range V20 including a speed range having an upper limit larger than the upper limit of the first speed range V10 while the pinion 42 is rotated by the hydraulic actuator 44 to steer the outboard motor body 102.

Specifically, when the operation mode is in the non-joystick mode, the controller 113 (see FIG. 2) controls the engine 31 (see FIG. 2) via the ECU 51 (see FIG. 2) to adjust the speed V of the marine vessel 120 within the second speed range V20. When the operation mode is in the non-joystick mode, the controller 113 also controls the steering mechanism 40 (see FIG. 4) via the SCU 52 (see FIG. 2) to rotate the pinion 42 (see FIG. 4) with the hydraulic actuator 44 (see FIG. 4) and adjust the angle A at which the outboard motor body 102 is steered within the first steering angle range A10.

On the other hand, when the operation mode is in the joystick mode, the controller 113 (see FIG. 2) controls the engine 31 (see FIG. 2) via the ECU 51 (see FIG. 2) to adjust the speed V of the marine vessel 120 within the first speed range V10. When the operation mode is in the joystick mode, the controller 113 also controls the steering mechanism 40 (see FIG. 4) via the SCU 52 to rotate the pinion 42 (see FIG. 4) with the electric motor 45 (see FIG. 4) and adjust the angle A at which the outboard motor body 102 is steered within the second steering angle range A20.

The lower limit of the first speed range V10 is about 0 (m/s), and the upper limit thereof is set to V1 (m/s). The lower limit of the second speed range V20 is about 0 (m/s), and the upper limit thereof is set to V2 (m/s). The speed V1 is lower than the speed V2. The speed V2 corresponds to the maximum speed of the marine vessel 120. That is, the second speed range V20 includes the first speed range V10 and a speed range having an upper limit larger than the upper limit of the first speed range V10.

The lower limit of the first steering angle range A10 is about 0 degrees, and the upper limit thereof is set to A1. The lower limit of the second steering angle range A20 is about 0 degrees, and the upper limit thereof is set to A2. The angle A1 is smaller than the angle A2. The angle A1 is about 30 degrees or more and about 45 degrees or less. That is, the second steering angle range A20 includes the first steering angle range A10 and an angular range having an upper limit larger than the upper limit of the first steering angle range A10.

Figure 6:
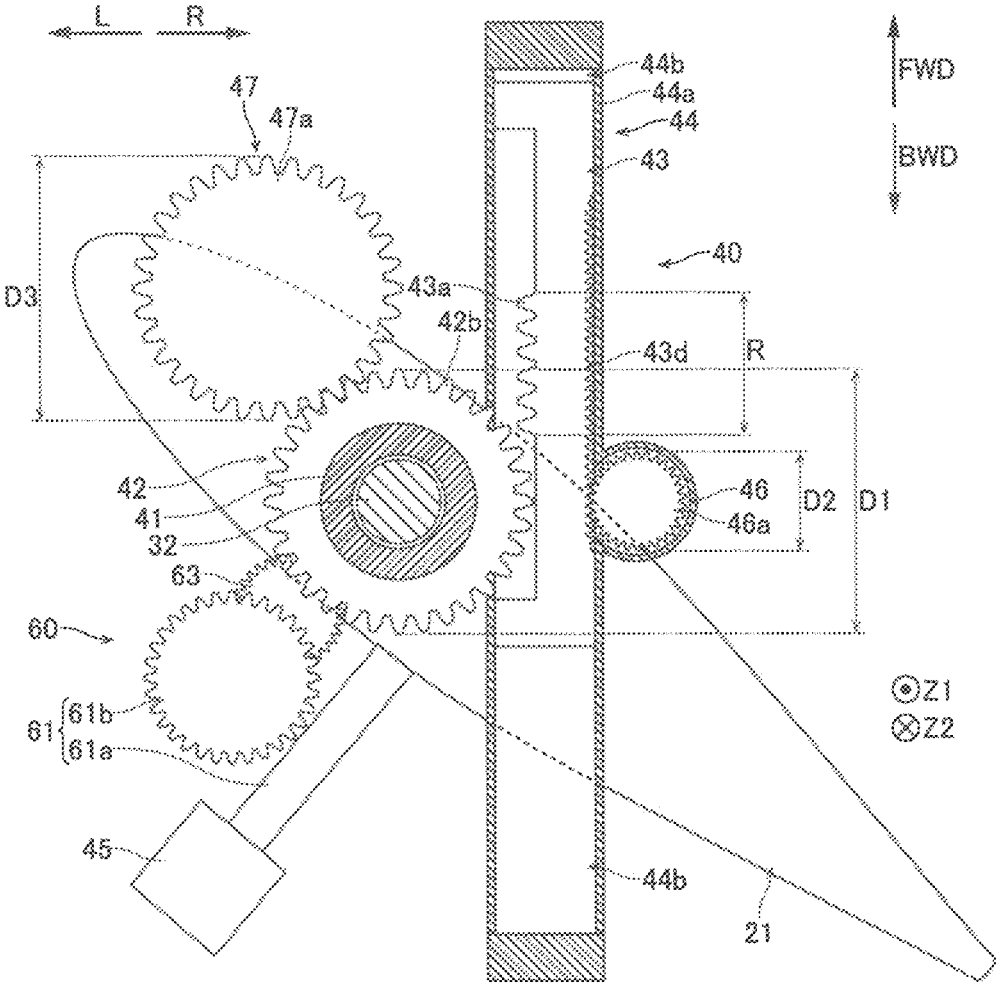
FIG. 6 is a plan view showing a state in which a rack does not engage with a pinion in a steering mechanism of an outboard motor according to a preferred embodiment of the present invention.

As shown in FIG. 6, when the pinion 42 is rotated by the hydraulic actuator 44, the steering mechanism 40 engages the rack 43 with the pinion 42, and when the pinion 42 is not rotated by the hydraulic actuator 44, the steering mechanism 40 does not engage the rack 43 with the pinion 42. Specifically, the teeth 43*a* of the rack 43 that engage with the pinion 42 are provided in a predetermined range R in the longitudinal direction of the rack 43 such that the rack 43 engages with the pinion 42 when the pinion 42 is rotated by the hydraulic actuator 44, and the rack 43 does not engage with the pinion 42 when the pinion 42 is not rotated by the hydraulic actuator 44. FIG. 6 shows a state in which the rack 43 does not engage with the pinion 42.

The steering mechanism 40 includes a rack position detector 46 to detect the position of the rack 43. The rack position detector 46 is provided on the side (first side) opposite to the pinion 42 with respect to the rack 43. The rack position detector 46 includes a rack position detection gear 46*a* to engage with a detector-side gear portion 43*d* provided on the rack position detector 46 side of the rack 43. The rack position detection gear 46*a* rotates as the rack 43 linearly moves. The rack position detector 46 detects the position of the rack 43 by detecting the rotation angle of the rack position detection gear 46*a*. The rack position detection gear 46*a* is an example of a "detected rotary member".

The tooth pitches of the detector-side gear portion 43*d* and the rack position detection gear 46*a* are smaller than the tooth pitch of the pinion 42. Along with this, the outer diameter D2 of the rack position detection gear 46*a* is smaller than the outer diameter D1 of the pinion 42. Specifically, the outer diameter D2 of the rack position detection gear 46*a* is less than or equal to half of the outer diameter D1 of the pinion 42.

The steering mechanism 40 includes a pinion position detector 47 to detect the rotational position of the pinion 42. The pinion position detector 47 includes a pinion position detection gear 47*a* to engage with the teeth 42*a* of the pinion 42. The pinion position detection gear 47*a* rotates as the pinion 42 rotates. The pinion position detector 47 detects the rotational position of the pinion 42 by detecting the rotation angle of the pinion position detection gear 47*a*.

The gear ratio of the pinion position detection gear 47*a* to the pinion 42 is about 1:1. That is, the number of teeth of the pinion position detection gear 47*a* is equal or substantially equal to the number of teeth of the pinion 42. The tooth pitch of the pinion position detection gear 47*a* is equal or substantially equal to the tooth pitch of the pinion 42. Furthermore, the outer diameter D3 of the pinion position detection gear 47*a* is equal or substantially equal to the outer diameter D1 of the pinion 42.

According to the various preferred embodiments of the present invention described above, the following advantageous effects are achieved.

According to a preferred embodiment of the present invention, the steering mechanism 40 includes the rack 43 operable to linearly move to rotate the pinion 42, and the rack position detector 46 to detect the position of the rack 43. Accordingly, the position of the rack 43 that linearly moves is detected by the rack position detector 46 such that the rotational position of the pinion 42 that rotates together with the outboard motor body 102 is detected. That is, the angle A at which the outboard motor body 102 is rotated about the steering shaft 41 is detected. Furthermore, as described above, the rack position detector 46 is provided on the side opposite to the pinion 42 with respect to the rack 43. That is, the rack position detector 46 is not coaxial with the pinion 42 and is spaced apart from the pinion 42. Consequently, the angle A at which the outboard motor body 102 is rotated about the steering shaft 41 is detected at a position spaced apart from the steering shaft 41 without providing coaxially with the steering shaft 41 a detector to detect the angle A at which the outboard motor body 102 is rotated about the steering shaft 41. Furthermore, the rack position detector 46 is provided on the side opposite to the pinion 42 with respect to the rack 43 such that when a driving mechanism (driving force transmission mechanism 60) is provided separately from the rack 43 on the pinion 42 side with respect to the rack 43 to drive the pinion 42, the rack position detector 46 does not interfere with the driving mechanism.

According to a preferred embodiment of the present invention, the rack position detector 46 includes the rack position detection gear 46*a* operable to rotate as the rack 43 linearly moves. Accordingly, the position of the rack 43 that linearly moves is easily detected by detecting rotation of the rack position detection gear 46*a*.

According to a preferred embodiment of the present invention, the rack 43 includes the detector-side gear portion 43*d* provided on the rack position detector 46 side of the rack 43. The rack position detector 46 includes the rack position detection gear 46*a* operable to engage with the detector-side gear portion 43*d*. Accordingly, the position of the rack 43 that linearly moves is more easily detected by detecting the rotational position of the rack position detection gear 46*a* that engages with the detector-side gear portion 43*d* of the rack 43.

According to a preferred embodiment of the present invention, the outer diameter D2 of the rack position detection gear 46*a* is smaller than the outer diameter D1 of the pinion 42. Accordingly, when the outer diameter D1 of the pinion 42 is constant, the size of the rack position detection gear 46*a* is relatively small as compared with a case in which the outer diameter D2 of the rack position detection gear 46*a* is larger than the outer diameter D1 of the pinion 42, and thus the rack position detector 46 is provided in the steering mechanism 40 while an increase in the size of the steering mechanism 40 is reduced or prevented.

According to a preferred embodiment of the present invention, the outer diameter D2 of the rack position detection gear 46*a* is less than or equal to half of the outer diameter D1 of the pinion 42. Accordingly, when the outer diameter D1 of the pinion 42 is constant, the size of the rack position detection gear 46*a* is sufficiently small, and thus the rack position detector 46 is provided in the steering mechanism 40 while an increase in the size of the steering mechanism 40 is reliably reduced or prevented.

According to a preferred embodiment of the present invention, the tooth pitches of the detector-side gear portion 43*d* and the rack position detection gear 46*a* are smaller than the tooth pitch of the pinion 42. Accordingly, when the number of gear teeth is fixed, the outer diameter of the gear becomes smaller as the tooth pitch of the gear becomes smaller. Thus, the outer diameter D2 of the rack position detection gear 46*a* is easily smaller than the outer diameter D1 of the pinion 42 due to the tooth pitches of the detector-side gear portion 43*d* and the rack position detection gear 46*a* being smaller than the tooth pitch of the pinion 42.

According to a preferred embodiment of the present invention, the through-hole 42*a* is provided in the central portion of the pinion 42 as viewed in the upward-downward direction of the outboard motor body 102. The outboard motor body 102 includes the engine 31 on the upper side of the outboard motor body 102, the propeller 35 on the lower side of the outboard motor body 102, and the drive shaft 32 extending in the upward-downward direction of the outboard motor body 102 and operable to transmit a driving force from the engine 31 to the propeller 35. The drive shaft 32 penetrates through the through-hole 42*a* of the pinion 42. Accordingly, the drive shaft 32 penetrating through the through-hole 42*a* of the pinion 42 does not change its position in the outboard motor 100 even when the outboard motor body 102 is rotated about the steering shaft 41, and thus the outboard motor body 102 is rotated about the steering shaft 41 without preventing the drive shaft 32 from transmitting a driving force from the engine 31 to the propeller 35.

According to a preferred embodiment of the present invention, the steering mechanism 40 includes the hydraulic actuator 44 to drive the pinion 42 by linearly moving the rack 43, the driving force transmission mechanism 60 to transmit a driving force to the pinion 42, and the electric motor 45 to drive the pinion 42 via the driving force transmission mechanism 60. Furthermore, the steering mechanism 40 is switchable between a state in which the pinion 42 is rotated by the hydraulic actuator 44 such that the outboard motor body 102 is steerable within the first steering angle range A10, and a state in which the pinion 42 is rotated by the electric motor 45 such that the outboard motor body 102 is steerable within the second steering angle range A20 including at least an angular range different from the first steering angle range. Moreover, the steering mechanism 40 is operable to engage the rack 43 with the pinion 42 when the pinion 42 is rotated by the hydraulic actuator 44, and is operable to not engage the rack 43 with the pinion 42 when the pinion 42 is not rotated by the hydraulic actuator 44. The steering mechanism 40 further includes the pinion position detector 47 to detect the rotational position of the pinion 42. Accordingly, the pinion position detector 47 detects the rotational position of the pinion 42, and thus in combination with detection of the position of the rack 43 by the rack position detector 46, the rack 43 and the pinion 42 are engaged with each other at a preset, predetermined position when a state in which the rack 43 does not engage with the pinion 42 is switched to a state in which the rack 43 engages with the pinion 42.

According to a preferred embodiment of the present invention, the pinion position detector 47 includes the pinion position detection gear 47*a* to engage with the pinion 42. Accordingly, rotation of the pinion position detection gear 47*a* that engages with the pinion 42 is detected such that the rotational position of the pinion 42 is easily detected.

According to a preferred embodiment of the present invention, the gear ratio of the pinion position detection gear 47*a* to the pinion 42 is about 1:1. Accordingly, the rotation speed of the pinion position detection gear 47*a* is equal or substantially equal to the rotation speed of the pinion 42, and thus the apparatus structure is simplified. For example, when the gear ratio of the pinion position detection gear 47*a* to the pinion 42 is not about 1:1, one of the pinion position detection gear 47*a* and the pinion 42 may rotate two or more times while the other of the pinion position detection gear 47*a* and the pinion 42 rotates once. In such a case, it is necessary to provide a sensor to detect the rotation speed of one of the pinion position detection gear 47*a* and the pinion 42.

According to a preferred embodiment of the present invention, the steering mechanism 40 is switchable between a state in which the pinion 42 is rotated by the hydraulic actuator 44 such that the outboard motor body 102 is steerable within the first steering angle range A10, and a state in which the pinion 42 is rotated by the electric motor 45 such that the outboard motor body 102 is steerable within the second steering angle range A20 including an angular range having an upper limit larger than the upper limit of the first steering angle range A10. Accordingly, when the marine vessel 120 navigates at a relatively high speed V, the pinion 42 is rotated by the hydraulic actuator 44 to steer the outboard motor body 102 within the first steering angle range A10, as described above, such that a relatively large load to be applied to the drive source is easily received by a hydraulic pressure. When the marine vessel 120 navigates at a relatively low speed V, the pinion 42 is rotated by the electric motor 45 to steer the outboard motor body 102 within the second steering angle range A20 including an angular range having an upper limit larger than the upper limit of the first steering angle range A10, as described above, such that the outboard motor body 102 is easily steered at a relatively large angle A. That is, the two drive sources are appropriately used to steer the outboard motor body 102.

According to a preferred embodiment of the present invention, the outboard motor body 102 includes the upper portion 10 attached to the hull 110 via the bracket 101, and the lower portion 20 located below the upper portion 10 and on which the propeller 35 is provided. Furthermore, the steering mechanism 40 is operable to rotate the lower portion 20 about the steering shaft 41 with respect to the upper portion 10. Accordingly, in a structure in which the lower portion 20 is rotated about the steering shaft 41 with respect to the upper portion 10, the angle A at which the outboard motor body 102 is rotated about the steering shaft 41 is detected at a position spaced apart from the steering shaft 41 without providing coaxially with the steering shaft 41 a detector to detect the angle A at which the outboard motor body 102 is rotated about the steering shaft 41.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the steering mechanism 40 preferably rotates the lower portion 20 about the steering shaft 41 with respect to the upper portion 10 in preferred embodiments described above, the present invention is not restricted to this. In a preferred embodiment of the present invention, the steering mechanism may alternatively rotate the entire outboard motor body about the steering shaft with respect to the hull.

While the hydraulic actuator 44 and the electric motor 45 preferably correspond to the "first drive source" and the "second drive source", respectively, in preferred embodiments described above, the present invention is not restricted to this. In a preferred embodiment of the present invention, a drive source other than the hydraulic actuator may alternatively correspond to the "first drive source", or a drive source other than the electric motor may alternatively correspond to the "second drive source".

While the second steering angle range A20 preferably includes an angular range having an upper limit larger than the upper limit of the first steering angle range A10 in preferred embodiments described above, the present invention is not restricted to this. In a preferred embodiment of the present invention, the second steering angle range may not include an angular range having an upper limit larger than the upper limit of the first steering angle range. That is, the second steering angle range may include an angular range having a lower limit smaller than the lower limit of the first steering angle range.

While the gear ratio of the pinion position detection gear 47*a* to the pinion 42 is preferably about 1:1 in preferred embodiments described above, the present invention is not restricted to this. In a preferred embodiment of the present invention, the gear ratio of the pinion position detection gear to the pinion may not be about 1:1.

While the pinion position detector 47 preferably includes the pinion position detection gear 47*a* to engage with the pinion 42 in preferred embodiments described above, the present invention is not restricted to this. In a preferred embodiment of the present invention, the pinion position detector may not include the pinion position detection gear to engage with the pinion.

While the drive shaft 32 preferably penetrates through the through-hole 42*a* of the pinion 42 in preferred embodiments described above, the present invention is not restricted to this. In a preferred embodiment of the present invention, the drive shaft may not penetrate through the through-hole of the pinion.

While the tooth pitches of the detector-side gear portion 43*d* and the rack position detection gear 46*a* are preferably smaller than the tooth pitch of the pinion 42 in preferred embodiments described above, the present invention is not restricted to this. In a preferred embodiment of the present invention, the tooth pitches of the detector-side gear portion and the rack position detection gear may alternatively be equal to or larger than the tooth pitch of the pinion.

While the outer diameter D2 of the rack position detection gear 46*a* is preferably less than or equal to half of the outer diameter D1 of the pinion 42 in preferred embodiments described above, the present invention is not restricted to this. In a preferred embodiment of the present invention, the outer diameter of the rack position detection gear may alternatively be more than half of the outer diameter of the pinion.

While the outer diameter D2 of the rack position detection gear 46*a* is preferably smaller than the outer diameter D1 of the pinion 42 in preferred embodiments described above, the present invention is not restricted to this. In a preferred embodiment of the present invention, the outer diameter of the rack position detection gear may alternatively be equal to or larger than the outer diameter of the pinion.

While the rack position detection gear 46*a* that engages with the detector-side gear portion 43*d* preferably corresponds to the "detected rotary member" in preferred embodiments described above, the present invention is not restricted to this. In a preferred embodiment of the present invention, a member other than the rack position detection gear that engages with the detector-side gear portion may alternatively correspond to the "detected rotary member" as long as the same rotates with linear movement of the rack.

While one rack 43 is preferably provided for the pinion 42 in preferred embodiments described above, the present invention is not restricted to this. In a preferred embodiment of the present invention, a plurality of racks may alternatively be provided for the pinion.

While the rack 43 is preferably located on the starboard side of the pinion 42 in preferred embodiments described above, the present invention is not restricted to this. In a preferred embodiment of the present invention, the rack may alternatively be located on the port side of the pinion.

Figure 7:
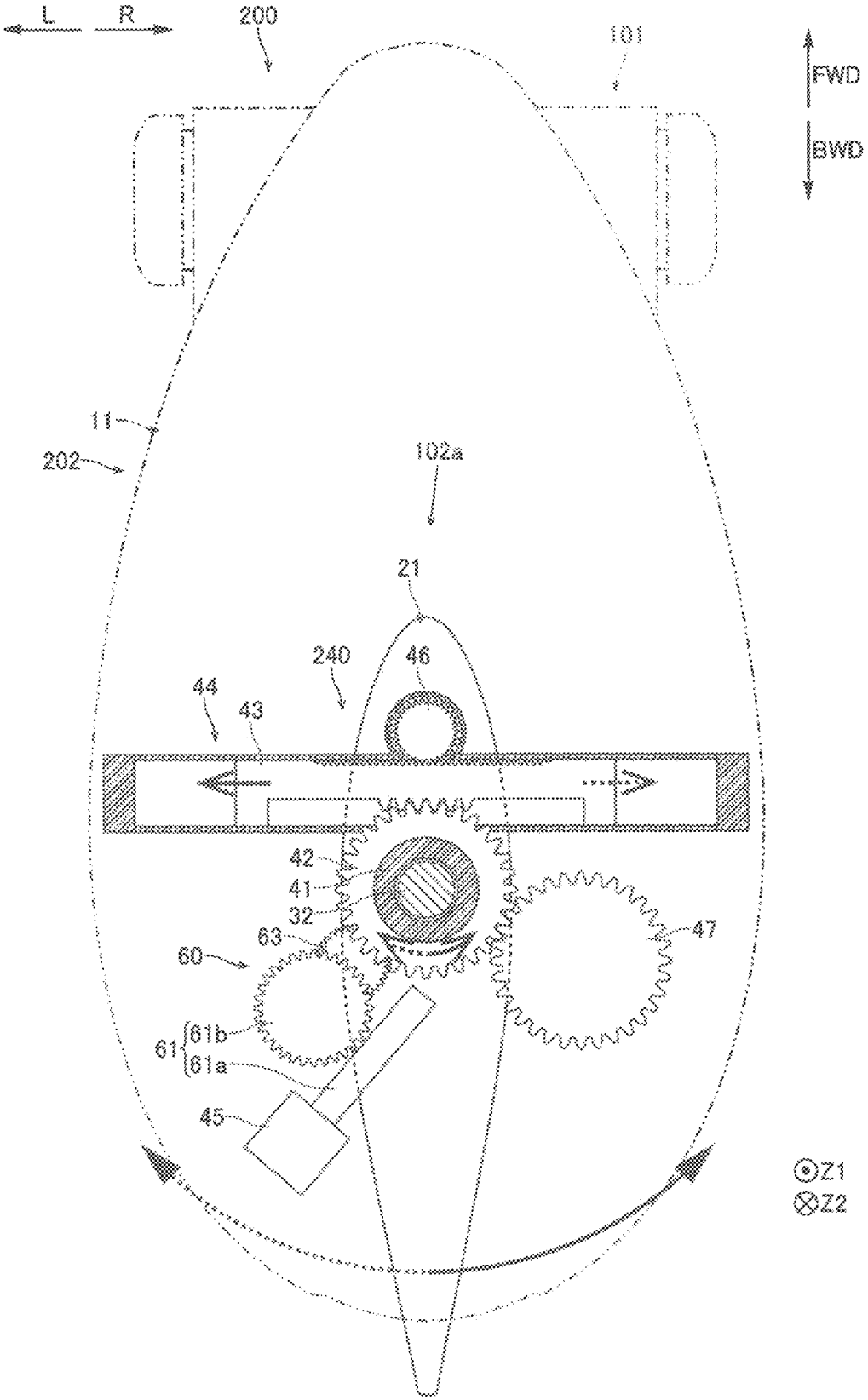
FIG. 7 is a plan view showing a steering mechanism of an outboard motor according to a first modified example of a preferred embodiment of the present invention.

While the rack 43 preferably extends along the forward-rearward direction of the outboard motor body 102 in preferred embodiments described above, the present invention is not restricted to this. In a preferred embodiment of the present invention, as in a first modified example shown in FIG. 7, a rack may alternatively extend along the right-left direction of an outboard motor body. As shown in FIG. 7, an outboard motor 200 according to the first modified example includes an outboard motor body 202 and a steering mechanism 240. In the steering mechanism 240, a rack 43 extends along the right-left direction of the outboard motor body 202. Although FIG. 7 shows an example in which the rack 43 is located on the front side of a pinion 42, the rack 43 may be located on the rear side of the pinion 42.

While the plurality of outboard motors 100 are preferably attached to the stern 111 of the hull 110 so as to be aligned in the right-left direction of the hull 110 in preferred embodiments described above, the present invention is not restricted to this. In a preferred embodiment of the present invention, only one outboard motor may alternatively be attached to the stern of the hull.

Figure 8:
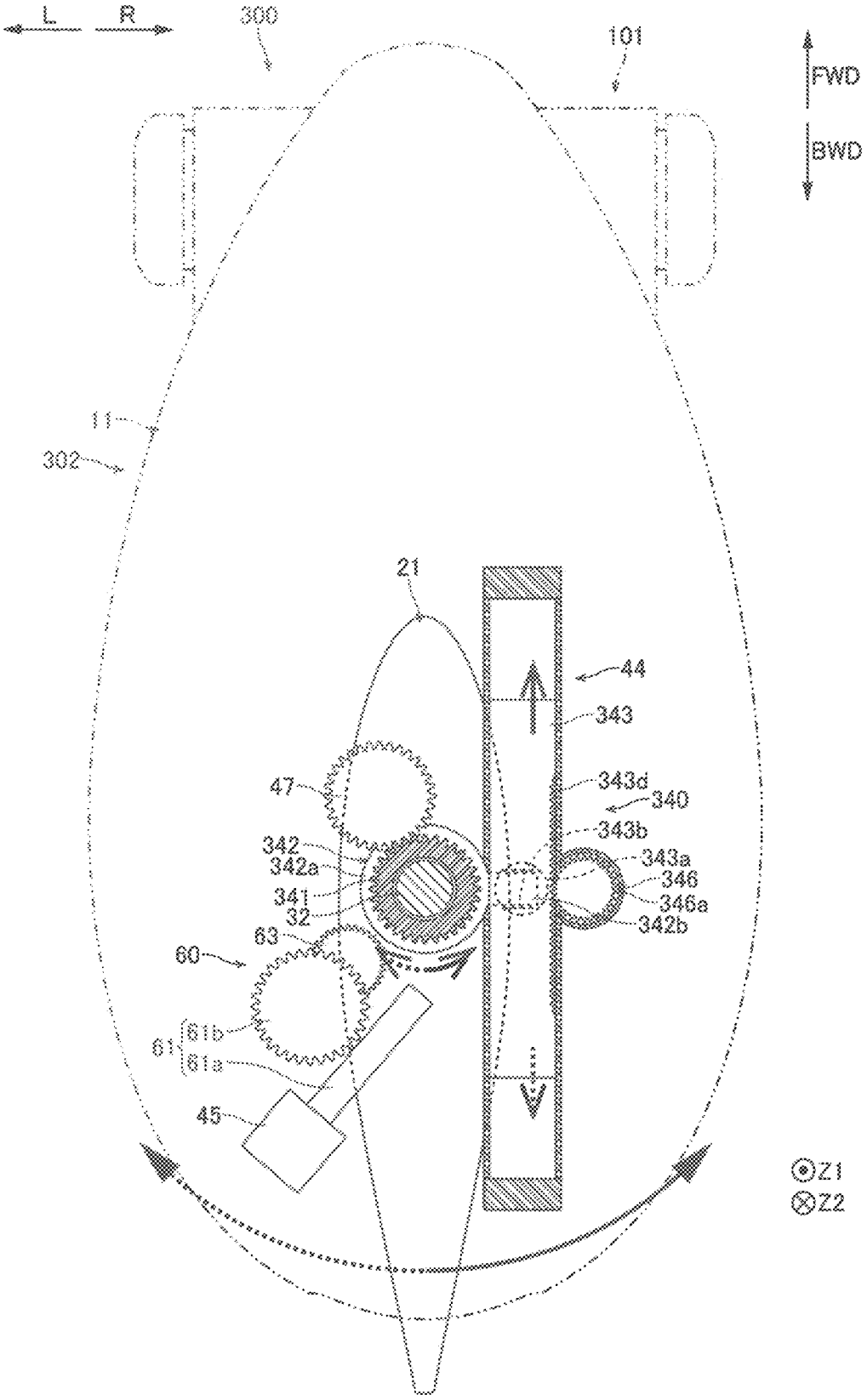
FIG. 8 is a plan view showing a steering mechanism of an outboard motor according to a second modified example of a preferred embodiment of the present invention.

While the steering mechanism 40 preferably converts linear motion into rotary motion with the rack 43 and the pinion 42 in preferred embodiments described above, the present invention is not restricted to this. In a preferred embodiment of the present invention, as in a second modified example shown in FIG. 8, a steering mechanism may alternatively convert linear motion into rotary motion with components other than a rack and a pinion. As shown in FIG. 8, an outboard motor 300 according to the second modified example includes an outboard motor body 302 and a steering mechanism 340 to rotate the outboard motor body 302 about a steering shaft 341. The steering mechanism 340 includes a link member 342 that rotates together with the outboard motor body 302, and a piston 343 that linearly moves to rotate the link member 342. Specifically, the link member 342 includes a cylindrical portion 342*a* that surrounds the steering shaft 341, and an arm 342*b* extending from the cylindrical portion 342*a* toward the piston 343. The cylindrical portion 342*a* is fixed to the steering shaft 341 by spline engagement such that the steering shaft 341 rotates as the cylindrical portion 342*a* rotates. The piston 343 is located in a central portion of the piston 343 in the forward-rearward direction of the outboard motor body 302, and includes a rotor 343*a* that is rotatable with respect to the piston 343. The arm 342*b* is fixed to the piston 343 by being fitted into a hole 343*b* of the rotor 343*a* of the piston 343. When the piston 343 is linearly moved in the forward-rearward direction of the outboard motor body 302, the position of the arm 342*b* with respect to the steering shaft 341 changes while the rotor 343*a* of the piston 343 rotates. As the position of the arm 342*b* with respect to the steering shaft 341 changes, the cylindrical portion 342*a* fixed to the steering shaft 341 rotates. Furthermore, the steering mechanism 340 includes a piston position detector 346 to detect the position of the piston 343. The piston position detector 346 includes a piston position detection gear 346*a* to engage with a detector-side gear portion 343*d* provided on the piston position detector 346 side of the piston 343. The link member 342, the piston 343, and the piston position detector 346 are examples of a "rotary member", a "linearly moving member", and a "linearly moving member position detector", respectively.

Figure 9:
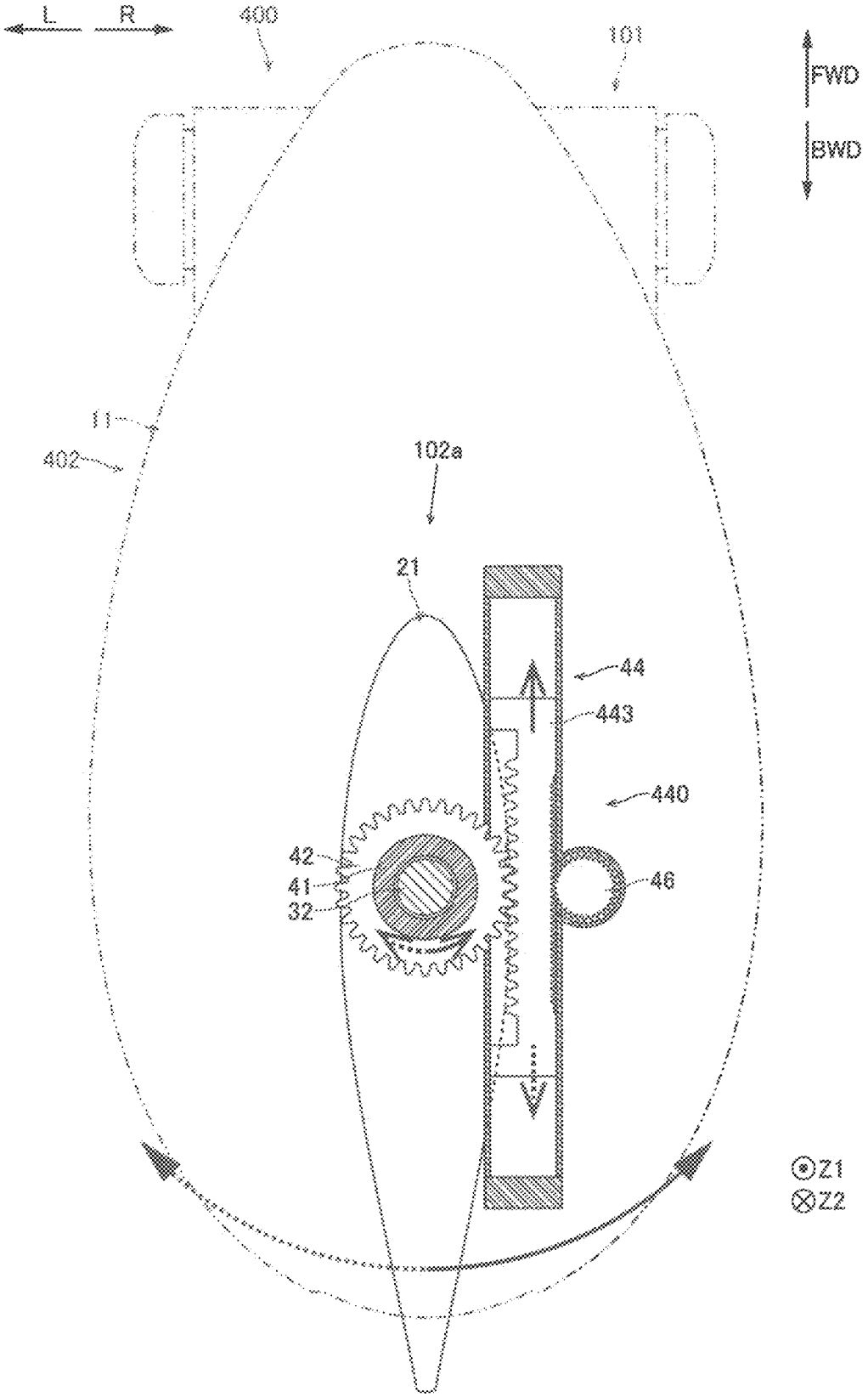
FIG. 9 is a plan view showing a steering mechanism of an outboard motor according to a third modified example of a preferred embodiment of the present invention.

While the steering mechanism 40 is preferably switchable between a state in which the pinion 42 is rotated by the hydraulic actuator 44 (first drive source) such that the outboard motor body 102 is steerable within the first steering angle range A10 and a state in which the pinion 42 is rotated by the electric motor 45 (second drive source) such that the outboard motor body 102 is steerable within the second steering angle range A20 including at least an angular range different from the first steering angle range A10 in preferred embodiments described above, the present invention is not restricted to this. In a preferred embodiment of the present invention, the steering mechanism may alternatively rotate the pinion with the first drive source to steer the outboard motor body within the first steering angle range but may not rotate the pinion with the second drive source to steer the outboard motor body within the second steering angle range including at least an angular range different from the first steering angle range. In such a case, as in a third modified example shown in FIG. 9, a steering mechanism may not include a driving force transmission mechanism to transmit a driving force to a pinion and a second drive source to drive the pinion via the driving force transmission mechanism. As shown in FIG. 9, an outboard motor 400 according to the third modified example includes an outboard motor body 402 and a steering mechanism 440. The steering mechanism 440 includes a rack 443 that linearly moves to rotate a pinion 42, and a hydraulic actuator 44 that linearly moves the rack 443 to drive the pinion 42. The steering mechanism 440 does not include the driving force transmission mechanism 60 or the electric motor 45 according to preferred embodiments described above. The steering mechanism 440 also does not include the pinion position detector 47 according to preferred embodiments described above.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:
an outboard motor body; and
a steering mechanism to rotate the outboard motor body about a steering shaft; wherein
the steering mechanism includes:
a pinion located in a central portion of the outboard motor body in a right-left direction and operable to rotate together with the outboard motor body;
a rack operable to linearly move to rotate the pinion; and
a rack position detector on a first side of the rack, opposite to a second side of the rack where the pinion is located, to detect a position of the rack.

2. The outboard motor according to claim 1, wherein the rack position detector includes a detected rotary member operable to rotate as the rack linearly moves.

3. The outboard motor according to claim 2, wherein
the rack includes a gear portion on the first side of the rack; and
the rack position detector includes a rack position detection gear corresponding to the detected rotary member operable to engage with the gear portion.

4. The outboard motor according to claim 3, wherein the rack position detection gear has an outer diameter smaller than an outer diameter of the pinion.

5. The outboard motor according to claim 4, wherein the outer diameter of the rack position detection gear is less than or equal to half of the outer diameter of the pinion.

6. The outboard motor according to claim 4, wherein the gear portion and the rack position detection gear have tooth pitches smaller than a tooth pitch of the pinion.

7. The outboard motor according to claim 1, wherein
the pinion includes a through-hole in a central portion of the pinion as viewed in an upward-downward direction of the outboard motor body; and
the outboard motor body includes:
an engine on an upper side of the outboard motor body;
a propeller on a lower side of the outboard motor body; and
a drive shaft extending in the upward-downward direction of the outboard motor body, operable to transmit a driving force from the engine to the propeller, and penetrating through the through-hole of the pinion.

8. The outboard motor according to claim 1, wherein
the steering mechanism further includes:
a first drive source to drive the pinion by linearly moving the rack;
a driving force transmission to transmit a driving force to the pinion; and
a second drive source to drive the pinion via the driving force transmission;
the steering mechanism is switchable between a state in which the pinion is rotated by the first drive source such that the outboard motor body is steerable within a first steering angle range, and a state in which the pinion is rotated by the second drive source such that the outboard motor body is steerable within a second steering angle range different from the first steering angle range;

the steering mechanism is operable to engage the rack with the pinion when the pinion is rotated by the first drive source, and is operable to not engage the rack with the pinion when the pinion is not rotated by the first drive source; and the steering mechanism further includes a pinion position detector to detect a rotational position of the pinion.

9. The outboard motor according to claim 8, wherein the pinion position detector includes a pinion position detection gear to engage with the pinion.

10. The outboard motor according to claim 9, wherein the pinion position detection gear has a gear ratio of about 1:1 to the pinion.

11. The outboard motor according to claim 8, wherein the steering mechanism is switchable between a state in which the pinion is rotated by a hydraulic actuator corresponding to the first drive source such that the outboard motor body is steerable within the first steering angle range, and a state in which the pinion is rotated by an electric motor corresponding to the second drive source such that the outboard motor body is steerable within the second steering angle range having an upper limit larger than an upper limit of the first steering angle range.

12. The outboard motor according to claim 1, wherein the outboard motor body includes:

an upper portion to be attached to a hull via a bracket; and a lower portion located below the upper portion and on which a propeller is provided; and the steering mechanism is operable to rotate the lower portion about the steering shaft with respect to the upper portion.

13. An outboard motor comprising:

an outboard motor body; and a steering mechanism to rotate the outboard motor body about a steering shaft; wherein the steering mechanism includes:

a rotary member located in a central portion of the outboard motor body in a right-left direction and operable to rotate together with the outboard motor body;

a linearly moving member operable to linearly move to rotate the rotary member; and a linearly moving member position detector on a first side of the linearly moving member, opposite to a second side of the linearly moving member where the rotary member is located, to detect a position of the linearly moving member.

14. A marine vessel comprising:

a hull; and an outboard motor attached to a stern of the hull; wherein the outboard motor includes:

an outboard motor body; and a steering mechanism to rotate the outboard motor body about a steering shaft; and the steering mechanism includes:

a pinion located in a central portion of the outboard motor body in a right-left direction and operable to rotate together with the outboard motor body;

a rack operable to linearly move to rotate the pinion; and a rack position detector on a first side of the rack, opposite to a second side of the rack where the pinion is located, to detect a position of the rack.

15. The marine vessel according to claim 14, wherein the rack position detector includes a detected rotary member operable to rotate as the rack linearly moves.

16. The marine vessel according to claim 15, wherein the rack includes a gear portion on the first side of the rack; and the rack position detector includes a rack position detection gear corresponding to the detected rotary member operable to engage with the gear portion.

17. The marine vessel according to claim 16, wherein the rack position detection gear has an outer diameter smaller than an outer diameter of the pinion.

18. The marine vessel according to claim 17, wherein the outer diameter of the rack position detection gear is less than or equal to half of the outer diameter of the pinion.

19. The marine vessel according to claim 17, wherein the gear portion and the rack position detection gear have tooth pitches smaller than a tooth pitch of the pinion.

20. The marine vessel according to claim 14, wherein the pinion includes a through-hole in a central portion of the pinion as viewed in an upward-downward direction of the outboard motor body; and the outboard motor body includes:

an engine on an upper side of the outboard motor body;

a propeller on a lower side of the outboard motor body; and a drive shaft extending in the upward-downward direction of the outboard motor body, operable to transmit a driving force from the engine to the propeller, and penetrating through the through-hole of the pinion.

* * * * *